US011092329B2

(12) United States Patent
Ansell

(10) Patent No.: US 11,092,329 B2
(45) Date of Patent: Aug. 17, 2021

(54) DETACHABLE DECORATIVE LED ASSEMBLY FOR WEARABLES AND METHOD OF USING THE SAME

(71) Applicant: Debra Ansell, Los Angeles, CA (US)

(72) Inventor: Debra Ansell, Los Angeles, CA (US)

(73) Assignee: Debra Ansell, Los Angeles, CA (US)

( * ) Notice: Subject to any disclaimer, the term of this patent is extended or adjusted under 35 U.S.C. 154(b) by 0 days.

(21) Appl. No.: 17/008,349

(22) Filed: Aug. 31, 2020

(65) Prior Publication Data

US 2021/0071859 A1 Mar. 11, 2021

Related U.S. Application Data

(60) Provisional application No. 62/897,526, filed on Sep. 9, 2019.

(51) Int. Cl.

| | |
|---|---|
| ***F21V 33/00*** | (2006.01) |
| ***F21V 21/005*** | (2006.01) |
| ***F21V 23/06*** | (2006.01) |
| ***F21V 23/00*** | (2015.01) |
| *F21Y 115/10* | (2016.01) |

(52) U.S. Cl.

CPC ..... *F21V 33/0008* (2013.01); *F21V 21/005* (2013.01); *F21V 23/005* (2013.01); *F21V 23/06* (2013.01); *F21Y 2115/10* (2016.08)

(58) Field of Classification Search

CPC .... F21V 33/0008; F21V 21/005; F21V 23/06; F21V 23/005; F21Y 2115/10

See application file for complete search history.

(56) References Cited

U.S. PATENT DOCUMENTS

| | | | | |
|---|---|---|---|---|
| 5,567,037 | A * | 10/1996 | Ferber | F21V 19/005 362/104 |
| 10,292,368 | B1 * | 5/2019 | Pierog | A01K 27/002 |
| 10,317,023 | B2 * | 6/2019 | Li | B29C 48/154 |
| 2010/0001664 | A1 * | 1/2010 | Shih | F21S 4/20 315/313 |
| 2013/0188335 | A1 * | 7/2013 | Marche | G09F 21/02 362/103 |
| 2016/0223149 | A1 * | 8/2016 | Gerpheide | F21V 33/0008 |

* cited by examiner

*Primary Examiner* — Tracie Y Green

(74) *Attorney, Agent, or Firm* — Treasure IP Group, LLC

(57) ABSTRACT

The present invention offers a new and innovative manner to integrate a flexible, programmable light source into a wearable item, particularly a garment, in a variety of different positions and placements. The flexible programmable light source assembly is designed to be attached to the garment in such a way that irrespective of whether the light source is ON or OFF, the appearance of the programmable light source assembly integrates harmoniously with the garment design. Further, when the programmable light source strip is removed, the empty area left behind is again fully integrated into the overall appearance of the wearable item.

14 Claims, 20 Drawing Sheets

Method of making

Method of making

Method of making

Method of making

Method of making

DETACHABLE DECORATIVE LED ASSEMBLY FOR WEARABLES AND METHOD OF USING THE SAME

TECHNICAL FIELD

The present invention relates to a modular decorative LED system that can be incorporated into a broad variety of wearable items, such as garments, shoes and accessories, for educational, social, safety, and aesthetic/decorative purposes. More particularly, the invention is directed to a modular programmable LED strip configured to be easily attached and de-attached to and from wearable items. When the programmable LED strip is added, it integrates with the wearable items naturally regardless of whether the LEDs are ON or OFF; and when the programmable LED strip is removed, the wearable item does not look awkward.

BACKGROUND OF THE INVENTION

Because of the long lifetime, a normal life of 30,000 hours, and environmental protection considerations, LEDs have been gradually but widely used in a variety of industrial or commercial products for illumination and entertainment purposes. LED lights with easy-to-make graphics, text, and other shapes, as decoration or signage, have been widely used in buildings, bridges, roads, gardens, patios, floors, ceilings, furniture, automobiles, ponds, underwater, advertisements, and so on. RGB LEDs that can display customizable color patterns in response to programmable instructions, have been gradually adopted in a wide variety personal items or household items like cards and toys.

However, decorative LED garments have yet to reach widespread popularity. Among many obstacles preventing LEDs to be used in flexible material, or semi-flexible material, in particular, fabrics for garments, four are major hurdles.

First, when a designer sets out to embed LEDs into the garments, the LEDs are usually attached to the garment permanently or in an extremely secure fashion. Consequently, it is very difficult or next to impossible to remove the LEDs alone or with the electronics when the garment needs to be washed.

Second, while illuminated LEDs create an attractive enhancement in a garment, when turned off, the unlit LEDs appear awkward and out of place, generating unwanted attention for the wearer. Additionally, if the LED assembly is removed from the garment, the garment will contain an empty area where the LEDs had been, making the garment appear unfinished and unattractive.

Third, if there is a problem with the electronics, the whole garment is rendered unwearable.

Fourth, the soft nature of garments often offers very little protection for the more fragile electronic components.

In view of the foregoing, there is a need for a convenient and esthetical way to integrate programmable LEDs and associated electronics into garments.

SUMMARY OF THE INVENTION

The present invention offers a new and innovative manner to integrate a flexible, programmable light source into a wearable item, particularly a garment, in a variety of different positions and placements. The flexible programmable light source assembly is designed to be attached to the garment in such a way that irrespective of whether the light source is ON or OFF, the appearance of the programmable light source assembly integrates harmoniously with the garment design. Further, when the programmable light source strip is removed, the empty area left behind is again fully integrated into the overall appearance of the wearable item.

It is one object of the present invention to provide a "modular" system containing one or more easily removable programmable light source strips to a wearable item such as a garment. Such modular system naturally integrates into the overall appearance of the wearable items in both light on and light off configurations.

It is another object of the present invention that the attachment means for the modular system is very durable and has aesthetic value. The attachment means should survive laundry conditions and allow the modular system to be attached and taken off repeatedly without being easily worn out.

It is another object of the present invention that the modular systems can display custom illumination patterns and to interact with the surrounding environment or with one another using sensors, Bluetooth, etc. Wearable articles having the modular system can be programmed to interact with each other, and detect and respond to information from the environment.

In accordance with the disclosure of the present invention, it describes the structure/components of the modular system, how the modular system is installed in a target system, how the target system is used electronically, and how the modular system is constructed.

The modular system is a flexible light source assembly, which can be programmed to display color patterns and messages.

According to a first primary aspect of the present invention, the structure of the modular system is described. The modular system comprises a flexible light source assembly, a controller assembly and a battery assembly. In the first primary aspect of variations of the modular system, the flexible light source assembly comprises a flexible light source strip, a cover strip, and an engagement-and-separation strip. The cover strip comprises a plurality of orifices, allowing the emission from the light source to exit from the cover strip. The flexible light source assembly may optionally comprise a diffusion layer, disposed between the flexible light source strip and a cover strip. Preferably, a plurality of orifices is provided with light fixtures to enhance the illumination effects.

In one variation of the first aspect of the present invention, the engagement-and-separation strip comprises a series of joining elements, secured on a substrate, distributed evenly along a length of the engagement-and-separation strip. The joining members include, are not limited to, zippers, Velcro, magnets, and buttons. In one embodiment, both sides of the cover strip are equipped with a zipper assembly through the engagement-and-separation strip. In another embodiment, both sides of the cover strip are equipped with a zipper assembly through the engagement-and-separation strip. In one example, the engagement-and-separation strip includes a full zipper assembly. In another example, the engagement-and-separation strip includes a half zipper assembly. In another example, the engagement-and-separation strip does not have a zipper assembly.

In accordance with the teachings of the present invention, disclosed herein, in a second aspect of variations of the modular system, is a wearable article, for example, a garment or accessory item enclosing the flexile light source assembly.

In one variation of the second aspect of the present invention, the wearable article comprising the flexible light source strip is disclosed. The flexible light source strip can be installed on to a garment or accessory item in various orientations including vertical, horizontal or an angled orientation, with respect to one seam line of the wearable article. In one example, the flexible light source strip can be placed vertically, from collar to bottom edge of a dress, jacket or skirt.

In another variation of the second aspect of the present invention, the wearable article comprises one or more of the flexible light source strips. In one embodiment, the wearable article comprises a single flexible light source strip. In another embodiment, the wearable article comprises two flexible light source strips. The two flexible light source strips may or may not connect to each other. In still another embodiment, the wearable article comprises an array of flexible light source strips, connecting through a neighboring engagement-and-separation strip.

In still another variation of the second aspect of the present invention, the wearable articles are garments and accessories, which include, are not limited to, a jacket, a dress, a skirt, a pair of pants, a tank top, a sneaker, a bag and a belt. The accessory further includes a replacement zipper, or an add-on zipper.

In yet another variation of the second aspect of the present invention, the flexible light source strip is able to be placed on various places of the wearable articles. In one embodiment, the flexible light source strip is placed on the front of a dress. In another embodiment, the flexible light source strip is placed on the bottom edge of a skirt. In another embodiment, the flexible light source strip is connected to an edge of a skirt. In still another embodiment, the flexible light source strip is installed on a sleeve of a top. In yet another embodiment, the flexible light source strip is on the side of the pant. The flexible light source strip is further capable of being placed on the shoes and a bag.

In accordance with the teachings of the present invention, disclosed herein, in a third aspect of variations of the modular system, a micro-controller assembly and a battery assembly is provided. In one embodiment, the controller is secured in the garment containing the flexible light source strip. In another embodiment, the controller is secured in the back of flexible light source strip.

In accordance with the teachings of the present invention, disclosed herein, in a fourth aspect, a method of using of the modular system is described.

In accordance with the teachings of the present invention, disclosed herein, a method of using the programmable light assembly is described. The interaction method offered by the present invention, allows a user to adjust illumination patterns/colors/brightness/timing protocol of the light source in the illumination elements. First a user inputs an instruction through a user interface, data is transmitted from the user interface to a microcontroller, then illumination instructions including color and timing protocol are computed and sent to the flexible light source strip.

In accordance with the teachings of the present invention, disclosed herein, in a fifth aspect, a method of how the modular system is constructed is described. The method comprises providing a light strip, a cover strip and an engagement-and-separation strip; securing the engagement-and-separation strip to the cover strip along one side of the cover strip through a first attachment means to form a first combined cover-engagement assembly, Flipping the first combined cover-engagement assembly over. Placing and fitting the light source strip inside a channel formed by a flap of the engagement and separation strip and cover strip and securing the light strip in place using a second securing means. The method further includes placing a protective bottom cover configured to protect the electronics of the light source strip on the back of the light source strip. Optionally, the method further comprises placing a diffusing layer between the light source strip and cover strip to diffuse the light from the light source.

BRIEF DESCRIPTION OF THE DRAWINGS

Non-limiting examples of various aspects and variations of the invention are described herein and illustrated in the accompanying drawings.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents that can be included within the spirit and scope of the described embodiments as defined by the appended claims.

DETAILED DESCRIPTION OF EXAMPLE EMBODIMENTS

Figure 1:
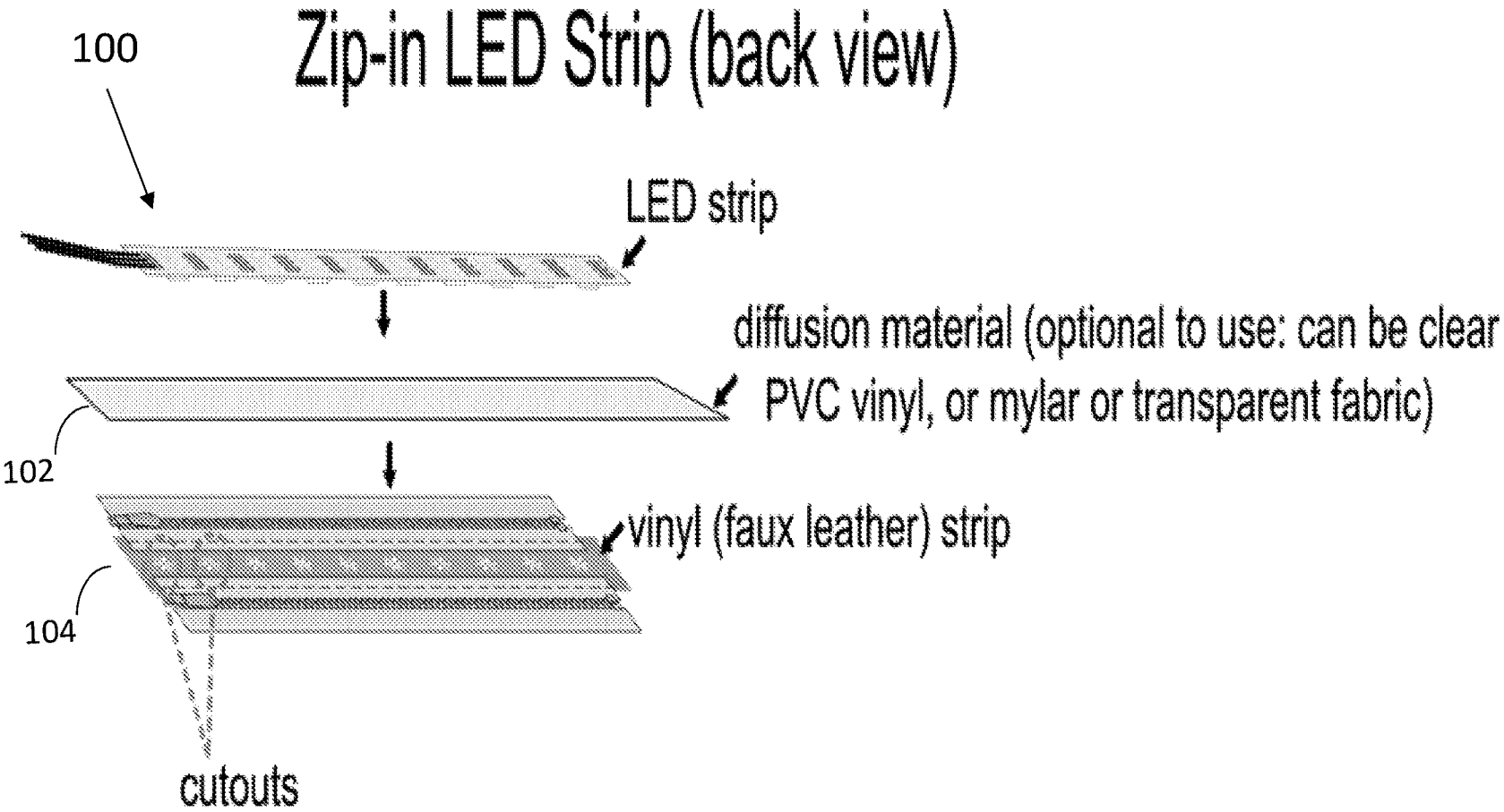
FIG. 1 provides a schematic illustration of the components for programmable light assembly.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents that can be included within the spirit and scope of the described embodiments as defined by the appended claims.

A first primary aspect of the present invention of the present invention is directed to the structure/components of the modular system.

A second primary aspect of the present invention of the present invention is directed to how the modular system is installed in a target system.

A third primary aspect of the present invention of the present invention is other components in the system.

A fourth primary aspect of the present invention of the present invention is directed to how the module system invention is used electronically.

A fifth primary aspect of the present invention of the present invention is directed to how the module system in the present invention is constructed.

Light Source

In the scope of the present invention, the light source includes both a point emission light source, for example a LED, or a laser, and an area emission light source, such as an organic limiting diode (OLED). In the embodiments of the present invention, the LED, specifically RGB LEDs are used. But it should not be construed that invention is limited to only LEDs.

Flexible Light Strip or Flexible Light Source Strip

In the scope of the present invention, flexible light strip means the light source and other electronic components are provided on a flexible substrate. Flexible substrate means the material can be bent, folded, wounded, adapted to a local, irregular tight space. The flexible substrate itself can be can be processed into different shapes. Strip means a long narrow piece of material. It is not limited to any particular shape. In the embodiments of the present invention, a rectangular shaped strip is used, however it should additionally include strips with shapes that have some degree of irregularity.

In the first aspect of the invention, the structure and function of the modular system is described in detail. In the second aspect of the invention, a method to use the modular system is described in detail. In the third aspect of the invention, a method to interact with the modular system is described in detail.

The present invention describes a programmable LED assembly as a strip, configured to be integrated into a wearable item. The programmable LED assembly strip comprises a flexible illumination strip bearing a plurality of RGB LED beads, a covering strip, configured to be placed on top of the light source strip, and an engagement-or-separate strip, configured to secure and/or separate part of the programmable LED assembly strip to and from a target wearable article. The flexible light source strip comprises a flexible printed circuit board (PCB) as a substrate and a plurality of RGB LEDs is placed on the flexible PCB at a pre-determined position, by adhesion or through a concave support base. The flexible PCB further comprises conductive elements. The conductive elements can either be wires and/or printed conductive coils.

In one example, the flexible LED assembly strip comprises a single line of the LEDs, along the length of the flexible LED strip. In another example, the flexible LED strip comprises an array of LEDs. In still another example, the LEDs are arranged to display letters or in a pattern such that selective turning could direct the display to show Alphabetic Letters or Arabic numerals.

The covering strip, comprises a plurality of openings. The covering strip is configured to be placed on top of the flexible LED strip, so that the plurality of openings corresponds with the plurality of LEDs, when the LEDs are on, the illumination of the LEDs will pass through the corresponding plurality of openings. The plurality of openings can have a wide variety of the shapes, for example, a flower shape or a round shape. Further, the plurality of openings of the covering strip may be provided with a plurality of LED bead covers or shades, which allow the light from the RGB LED beads to diffuse through. The LED bead shades are transparent covers that include, but are not limited to, rhinestones or glass cabochons.

Further, an optional diffusion layer can be added between the cover strip and light source strip. The diffusion layer could be one or more strips of translucent fabric, shiny reflective (but translucent) vinyl, or any flexible translucent material. The diffusion layer is configured to enhance the light effects.

The covering strip together with one or two engagement-and-separation strips can hold and secure the flexible programmable light source strip in place. There is no or only very minimal relative movement between the programmable light source strip and the covering strip.

An engagement-and-separation strip, comprised of a series of complementary pairs of joining elements, secured on a substrate, distributed evenly along a length of the engagement-or-separate strips. The complementary pairs of joining elements include, but are not limited to, zippers, Velcro, and buttons. On one side of the engagement-and-separation strip, a pair of flaps is provided, which extends along the longitudinal direction of the substrate and the flexible light source strip is sandwiched between the pair of flaps. On the other side of the engagement-and-separation strip, one single flap is provided, which is configured to be further connected to a target garment in an intended position, by adhesion or sewing.

In one embodiment, one engagement-and-separation strip is utilized and the programmable light source strip is configured to attach to an intended use position of a target garment through only one engagement-and-separation strip, leaving the other side of the programmable light source strip detached from the garment.

In another embodiment, a pair of engagement-and-separation strips are utilized and the programmable light source strip is configured to attach to an intended use position of a target garment through the pair of engagement-and-separation strips on both sides. The programmable light source strip is firmly secured to the garment.

In still another embodiment, one engagement-and-separation strip is only half of a conventional zipper. A conventional zipper comprises a pair of woven tapes a plurality of teeth, and a slider. The teeth are arranged along opposing edges of the two tapes to form mateable rows. In this embodiment, the one engagement-and-separation strip contains half of the mateable teeth. For example, on a left side of the cover strip, a column of first half zipper teeth is provided and on a right side of the cover strip, a column of second half zipper teeth is provided. The first half zipper teeth can mate with a first column of half location zipper teeth to form a complete row of zippers. The second half zipper teeth can mate with a second column of half location zipper teeth to form a complete row of zippers. In this example, when installed in the garment wherever a location zipper is present, the programmable LED assembly functions as an extension or bridge between two conventional zippers. Further the programmable LED assembly can be used as a replacement zipper to the original conventional location zipper.

Preferably, in addition to the light source strip, cover strip and engagement-and-separation strip, a protective layer is provided for the programmable LED assembly. The protective layer is a fabric layer which is placed outside of the area of the flaps of the engagement-and-separation strip, which can offer more structural integrity and protection, and serve to insulate the wearer from contact with the electronics in the LED assembly.

More importantly, the protective layer serves a decorative function, being made from materials which provide aesthetic enhancement to the target garment. In one example, the protective layer is a decorative layer, which is positioned on the target location in the garment. When the programmable LED strip is installed in the garment, the protective layer is hidden, and when the programmable LED strip is taken off from the garment, the protective layer is visible. The half zippers of the engagement-and-separation assembly and the protective layer are visually harmonious with the target location when the light source strip, cover strip and electronics are removed from the target location.

In accordance with the teachings of the present invention, disclosed herein, in a second aspect of variations of the modular system, is a wearable article, for example, a garment or accessory item enclosing the flexible light source assembly.

Figure 5:
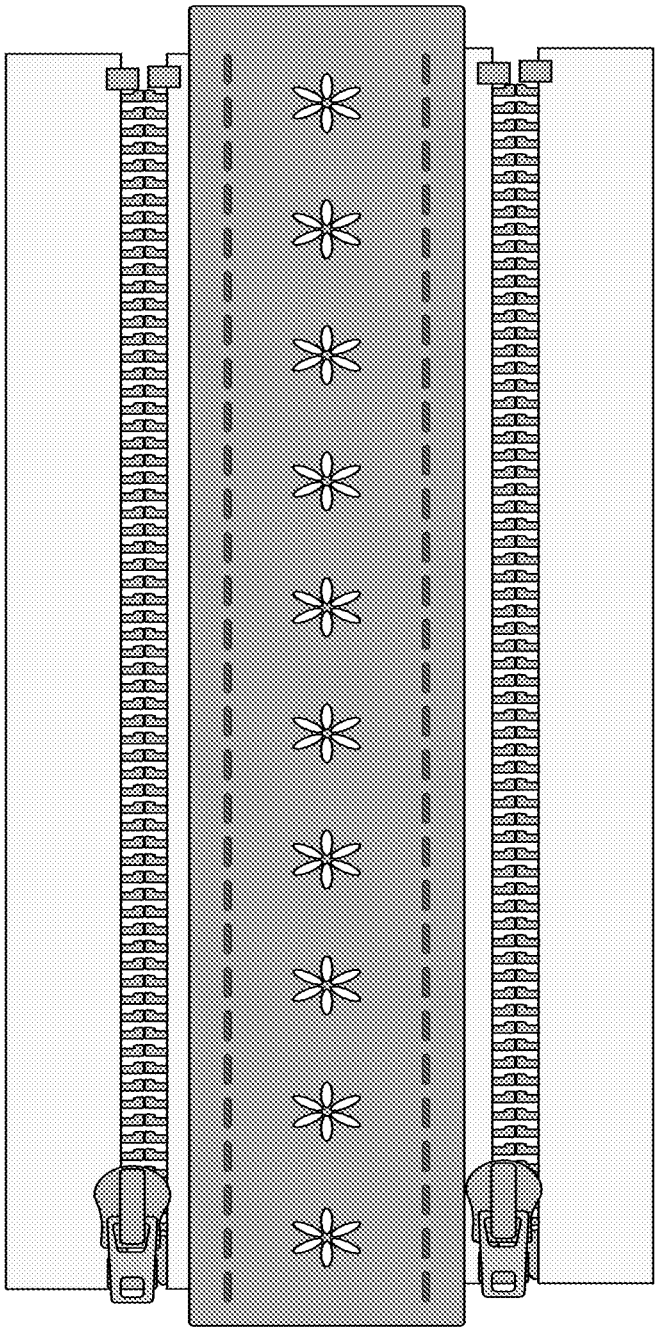
FIG. 5 shows a second engagement-and-separation strip is installed.
Figure 6:
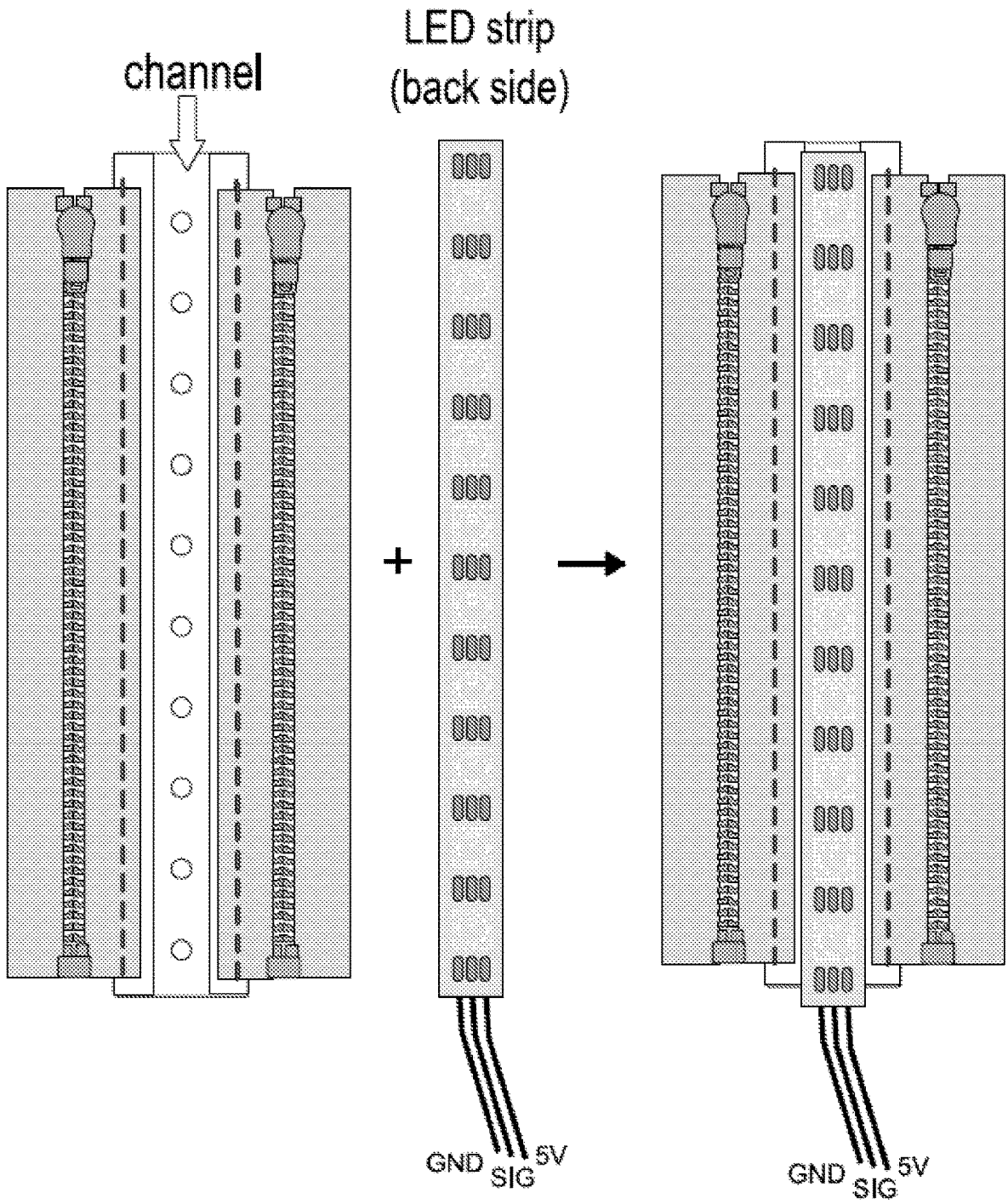
FIG. 6 shows a channel is formed by the cover strip and flap members of the engagement-and-separation strips, a light source strip can be placed and fitted into the channel to form a complete assembly, according to one embodiment of the present invention.
Figure 7:
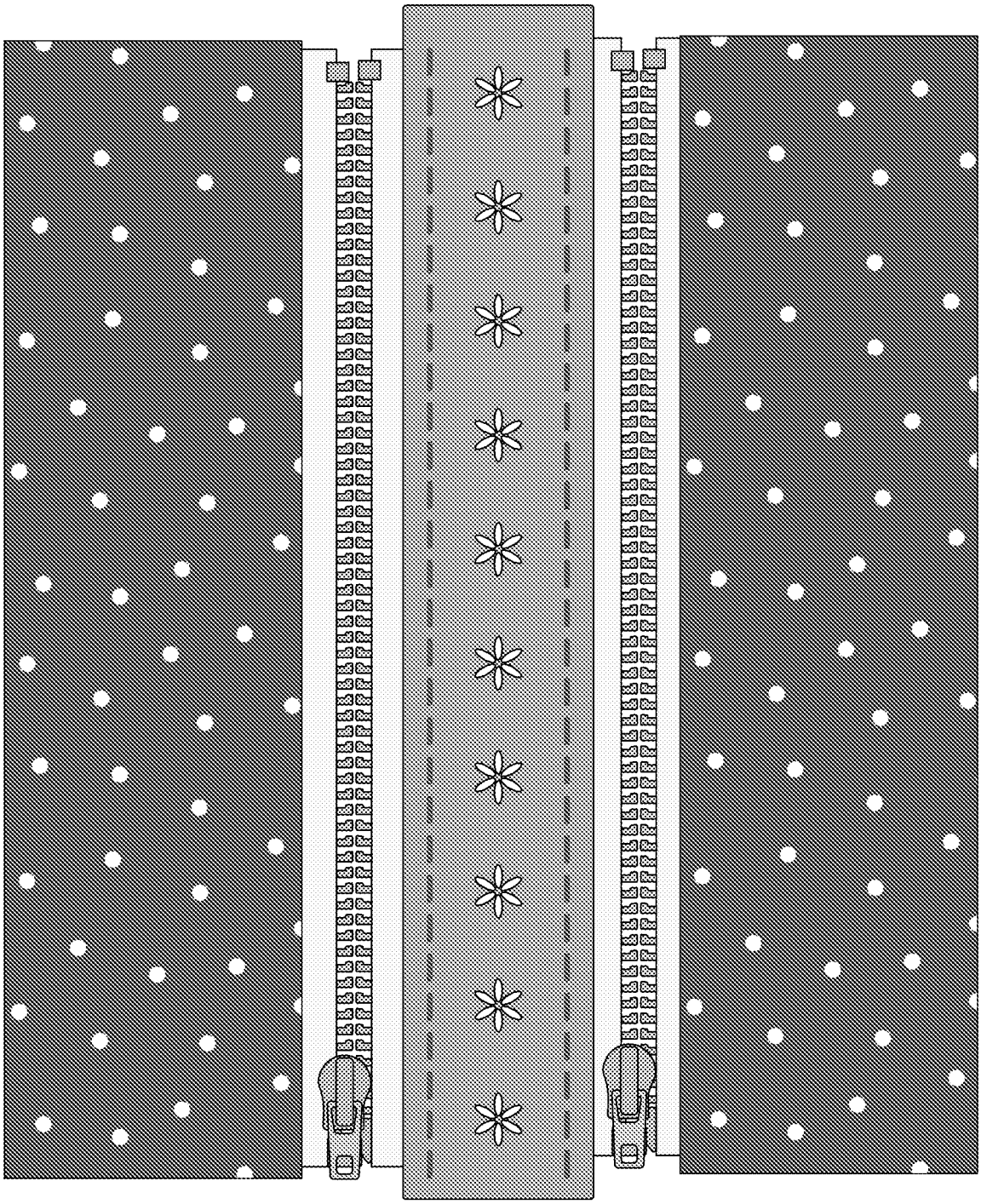
FIG. 7 shows the combined cover strip and engagement-and-separation strip can be further secured to the target region, according to one embodiment of the present invention.
Figure 8:
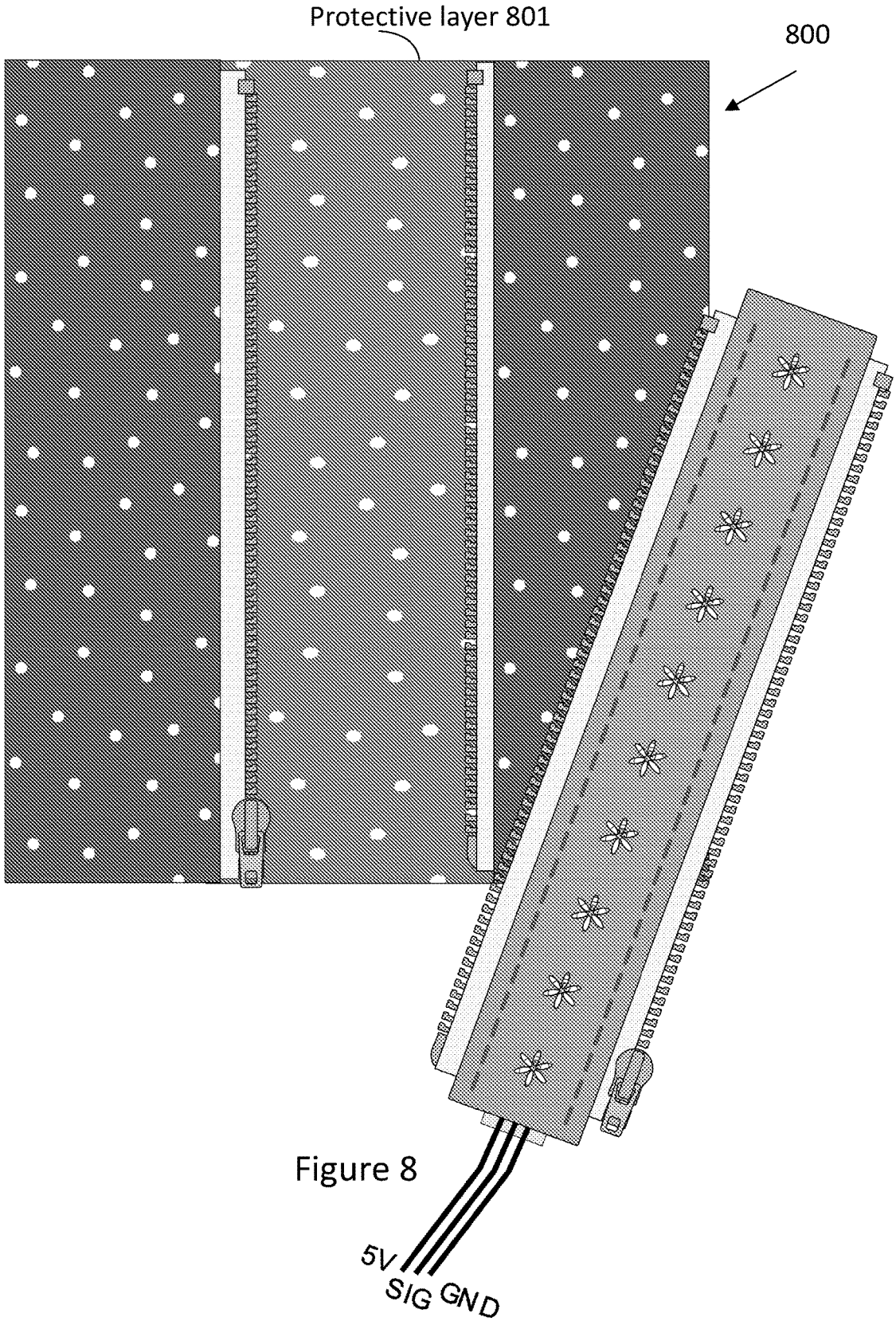
FIG. 8 illustrates that the flexible light source strip can be taken off from the target region by one separation configuration, in accordance with one aspect of the present invention.
Figure 9:
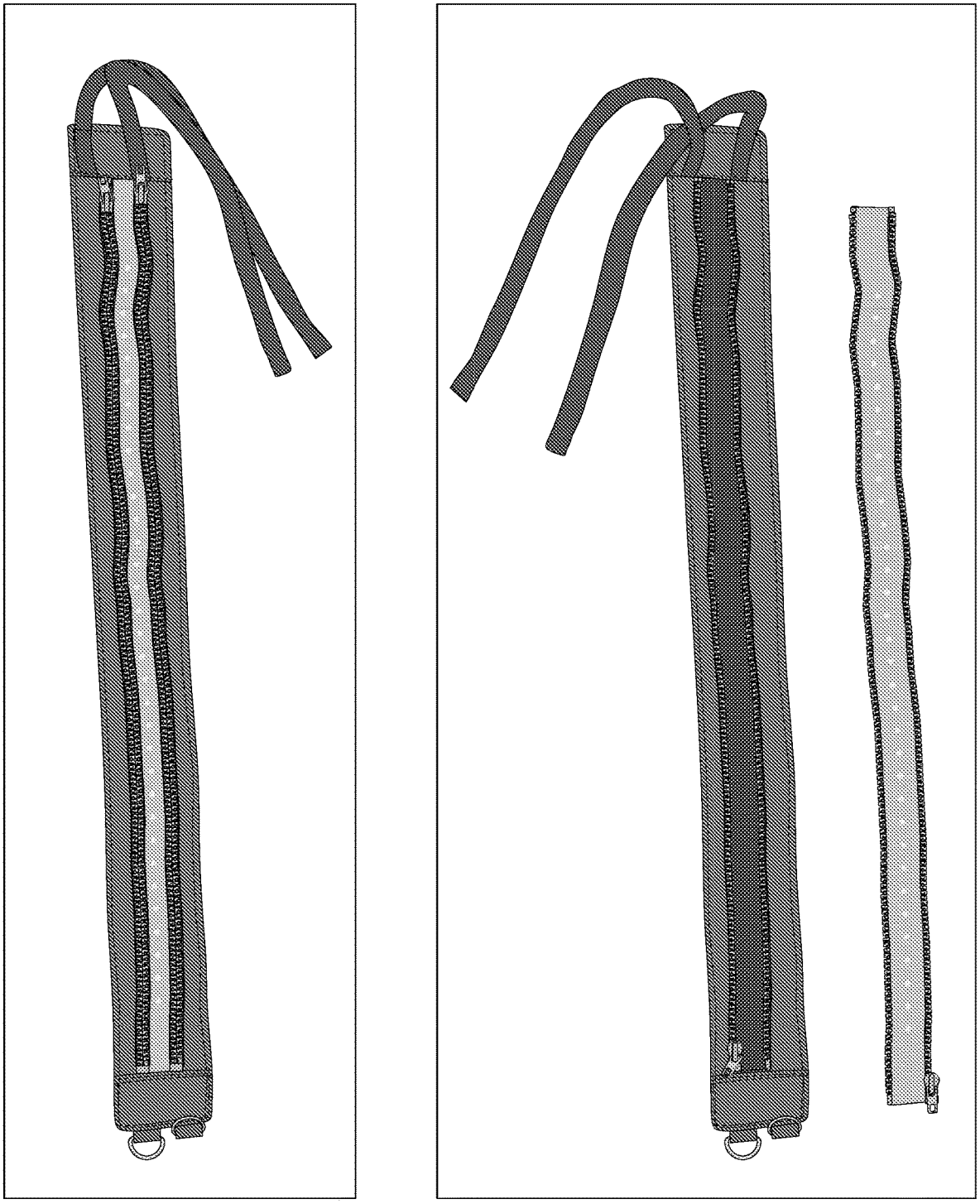
FIG. 9 illustrates a belt made of the programmable light assembly, having an engagement and a separation configuration, in accordance with one aspect of the present invention.
Figure 10:
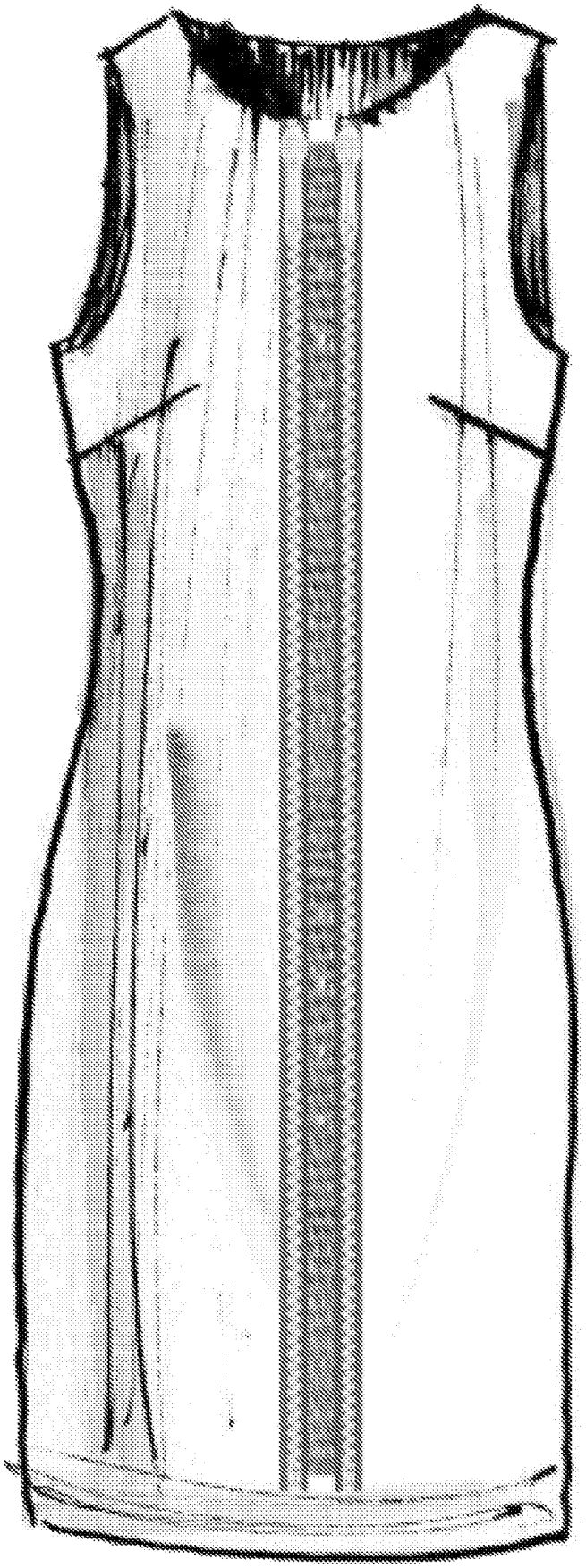
FIG. 10 illustrates a dress having programmable light assembly installed, according to one embodiment of the invention.
Figure 11:
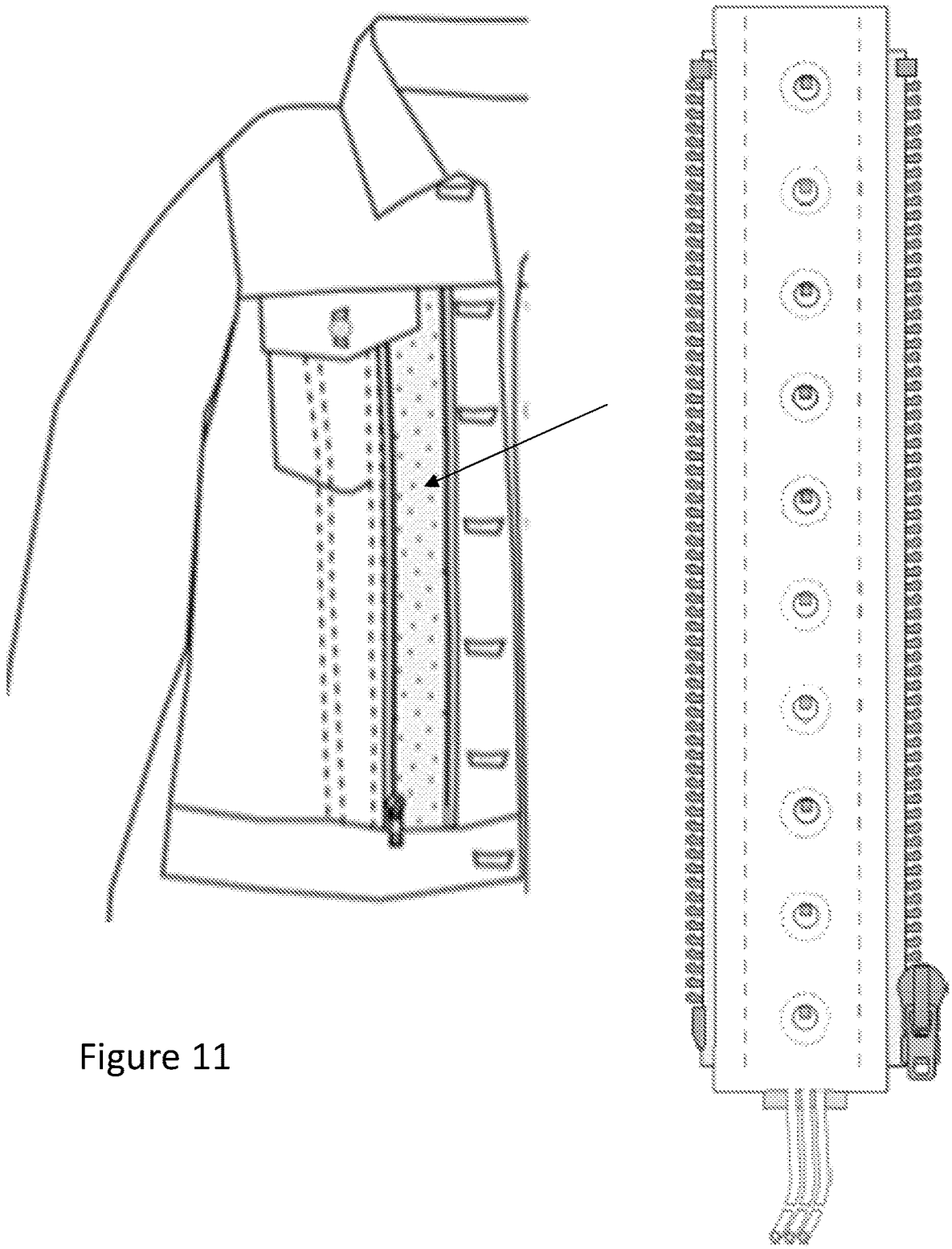
FIG. 11 illustrates a jacket having programmable light assembly installed, according to one embodiment of the invention.
Figure 13:
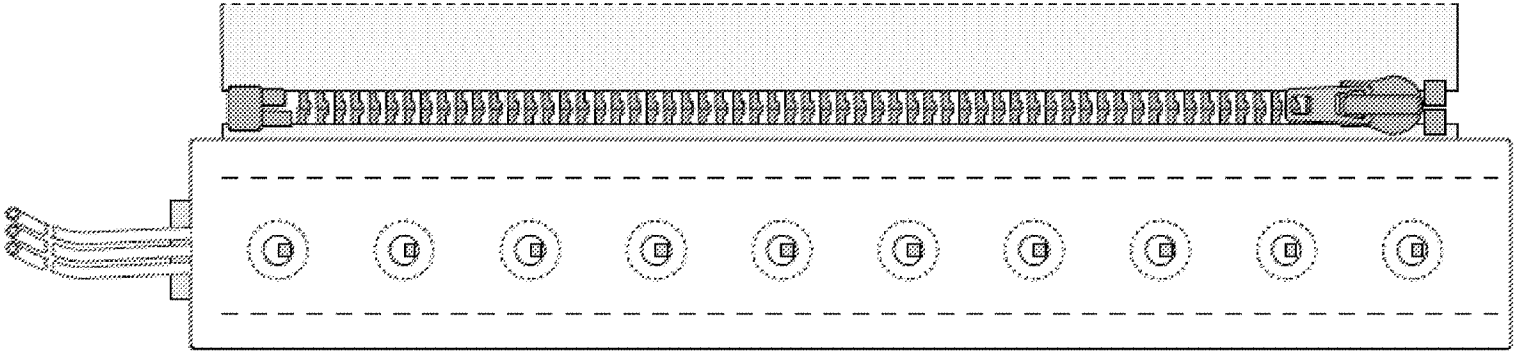
FIG. 13 illustrates a variation of the programmable light assembly installed, having only one engagement-and-separation strip, according to one embodiment of the invention.
Figure 14:
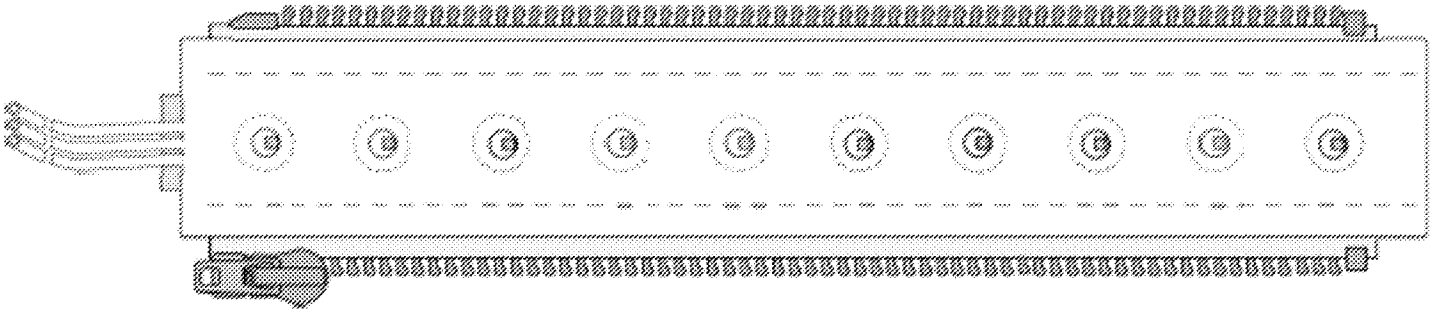
FIG. 14 illustrates another variation of the programmable light assembly installed, having only half zippers in both engagement-and-separation strip, according to one embodiment of the invention.
Figure 15:
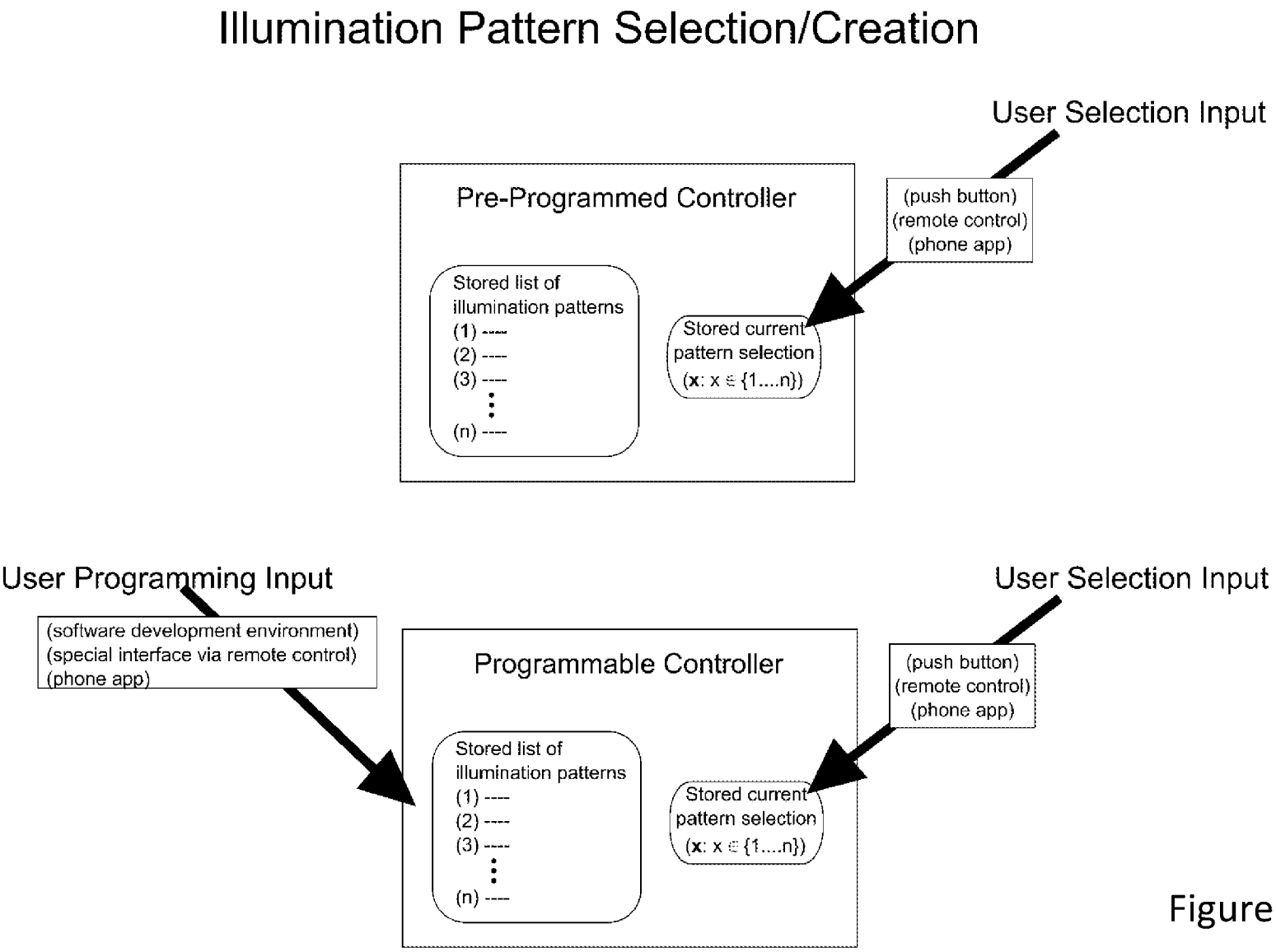
FIG. 15 illustrates how the illumination pattern is created and modified, in accordance with one aspect of the present invention.
Figure 20:
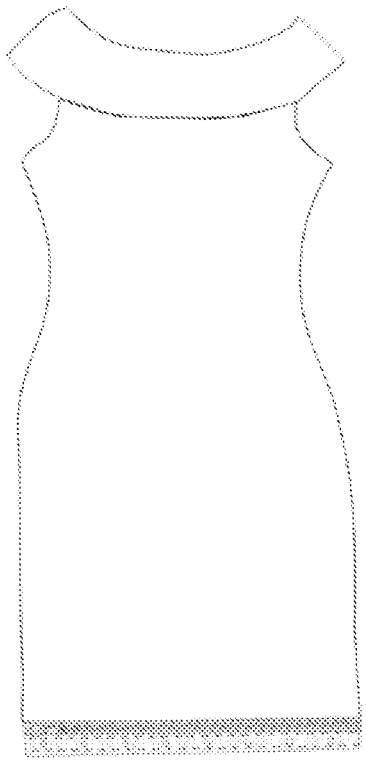
FIG. 20 is an embodiment illustrating that the lighting assembly of the present invention is attached to a bottom of a dress.
Figure 21:
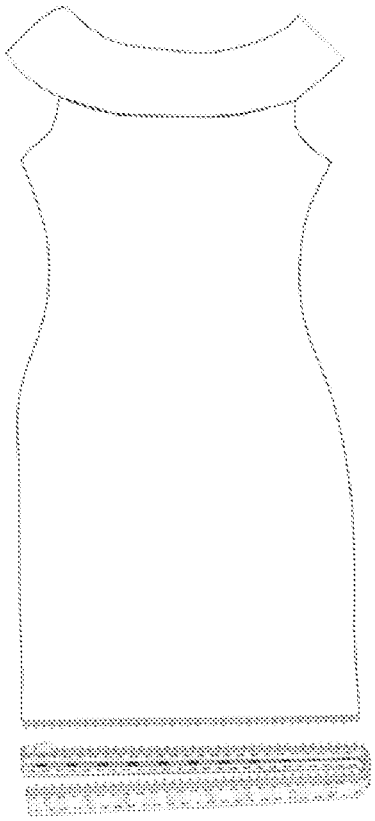
FIG. 21 is showing the embodiment of FIG. 20 when the lighting assembly is taken off from the dress.
Figure 22:
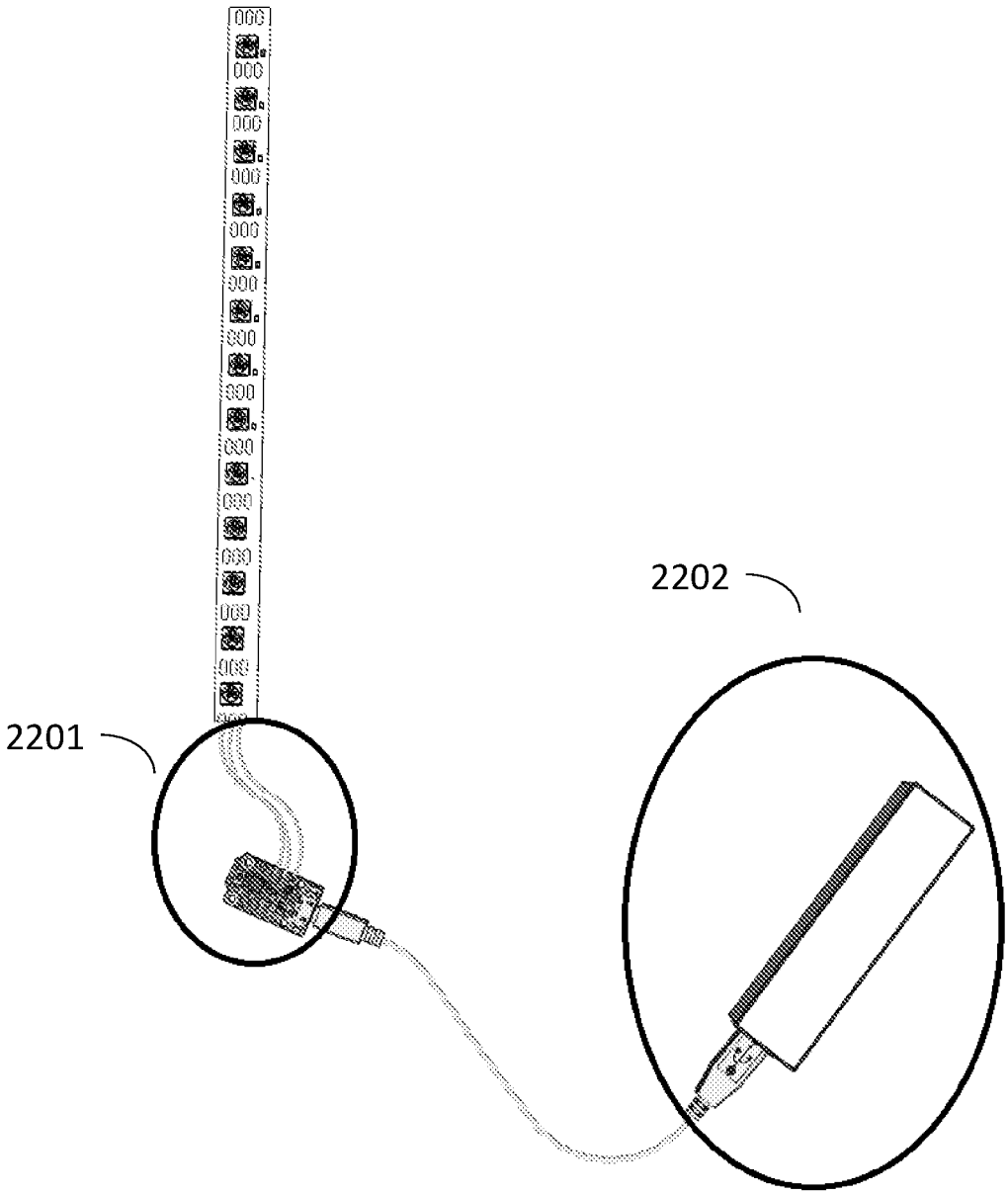
FIG. 22 is an illustration of the connection of light source strip with micro-controller assembly and batter assembly.
Figure 23:
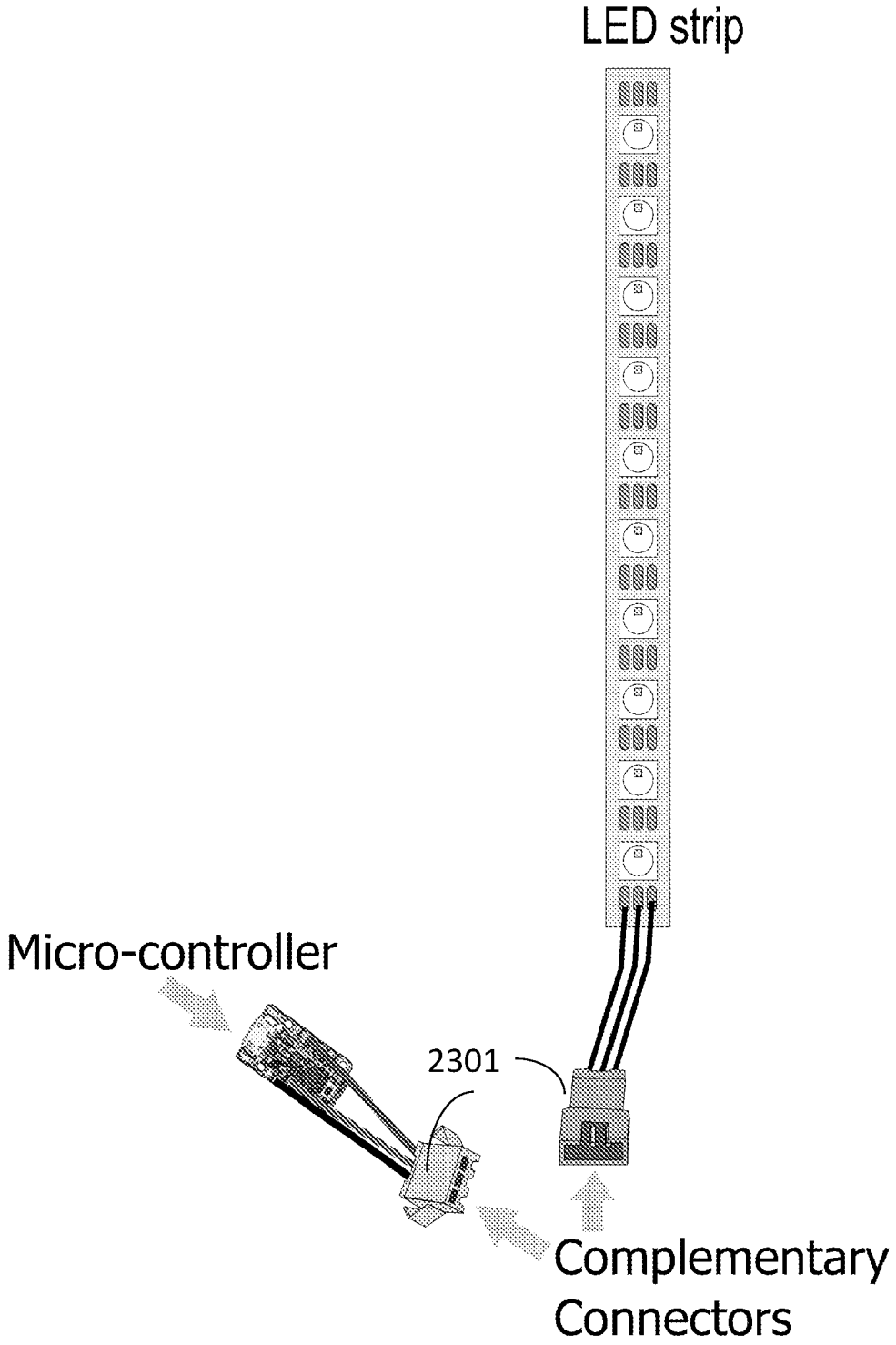
FIG. 23 is an illustration of a connector between the light source strip and micro-controller assembly.

The programmable LED assembly in the scope of the present invention includes three configurations. The first configuration is the assembly depicted in FIG. 5, and the assembly connects to the target garment through both side tapes as shown in FIG. 7. A second configuration is the assembly depicted in FIGS. 20 and 21, in which the LED assembly includes only one zipper assembly. The other side of the LED assembly dangles from the garment. In this single zipper assembly configuration, the programmable LED assembly is installed on an edge of the target garment, for example, the hem of a dress, or the end of a sleeve or cuff. A third configuration of the assembly is what is depicted in FIG. 13, wherein the zippers are only half of the zipper assembly on both side, which is configured to attach to an existing original zipper assembly in the target location.

In one variation of the second aspect of the present invention, the wearable article comprising the programmable LED assembly is disclosed. The programmable LED assembly can be installed into a garment or accessory item in various orientations including vertical, horizontal or an angled orientation, with respect to one seam line of the wearable article.

In one example, the programmable LED assembly can be placed vertically, from collar to bottom edge of a dress, jacket or skirt. In another example, the programmable LED assembly can be oriented horizontally, along a bottom seam or edge of a garment. In still another example, the programmable LED assembly can be oriented in an angled direction with respect to the bottom edge or seam of the garment or an area of the garment, for example a pant or a sleeve.

Figure 12:
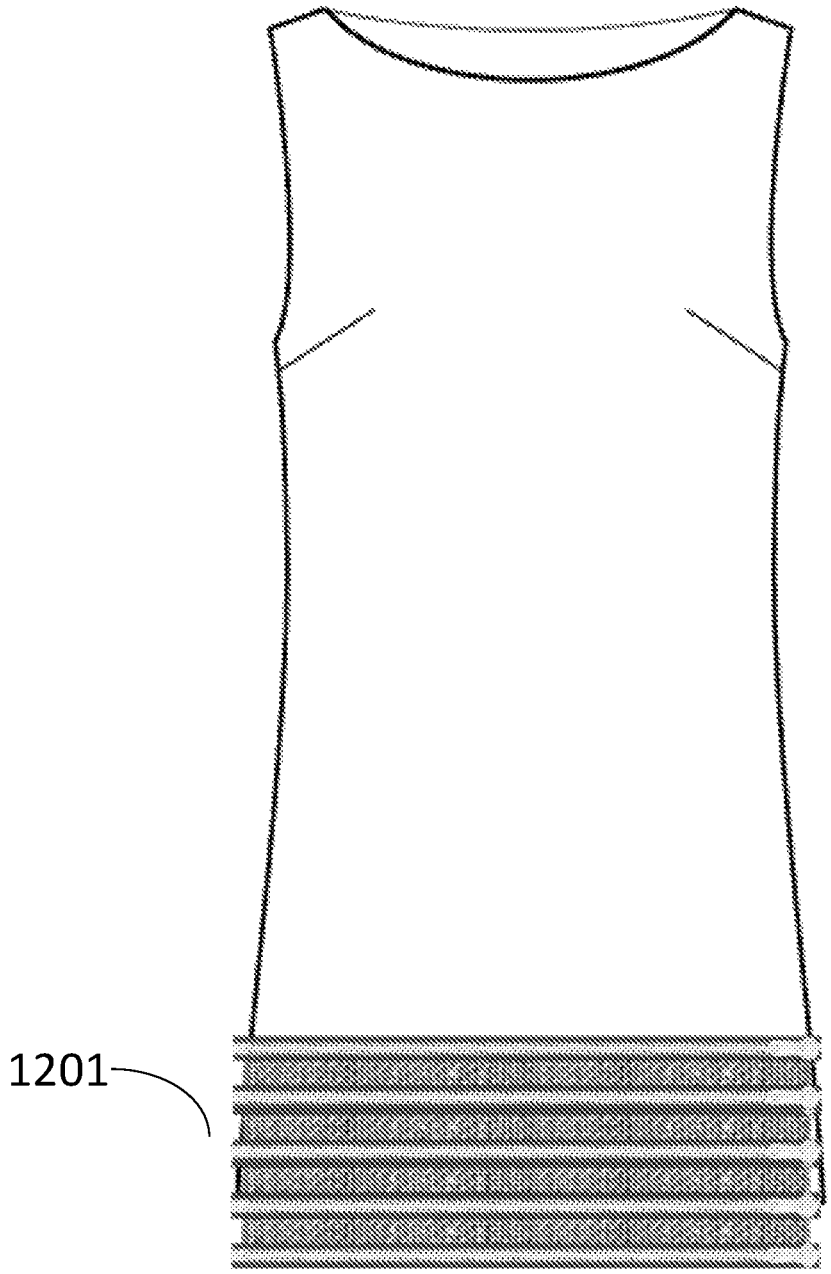
FIG. 12 illustrates a matrix of the programmable light assembly installed, according to one embodiment of the invention.

In another variation of the second aspect of the present invention, the wearable article comprises one or more of the flexible light source strips. In one embodiment, the wearable article comprises a single flexible light source strip. In another embodiment, the wearable article comprises two flexible light source strips. The two flexible light source strips may or may not connect to each other. In still another embodiment, the wearable article comprises an array of flexible light source strips, connecting through a neighboring engagement-and-separation strip. For example, referring to FIG. 12, a continuous series of LED assemblies are attached to a target location of the garment.

In still another variation of the second aspect of the present invention, the wearable articles are garments and accessories, which include, but are not limited to, a jacket, a dress, a skirt, a pair of pants, a tank top, a sneaker, a bag and a belt. The accessory further includes a replacement zipper, or an add-on zipper.

In yet another variation of the second aspect of the present invention, the flexible light source strip is able to be placed in various locations on the wearable articles. In one embodiment, the flexible light source strip is placed on the front of a dress. In another embodiment, the flexible light source strip is placed on the bottom edge of a skirt. In another embodiment, the flexible light source strip is connected to an edge of a skirt. In still another embodiment, the flexible light source strip is installed on a sleeve of a top. In yet another embodiment, the flexible light source strip is on the side of the pant. The flexible light source strip is further able to of be placed on shoes and a bag.

In accordance with the teachings of the present invention, disclosed herein, in a third aspect of variations of the modular system, a micro-controller assembly and a battery assembly is provided. In one embodiment, the controller is secured in the garment containing the flexible light source strip and separate from the light source strip. The wearable item may contain pockets to hold batteries or micro-controllers. In another embodiment, the controller is secured in the back of flexible light source strip, and the wearable item contains complementary fasteners to firmly hold the electronic strip in place.

Figure 16:
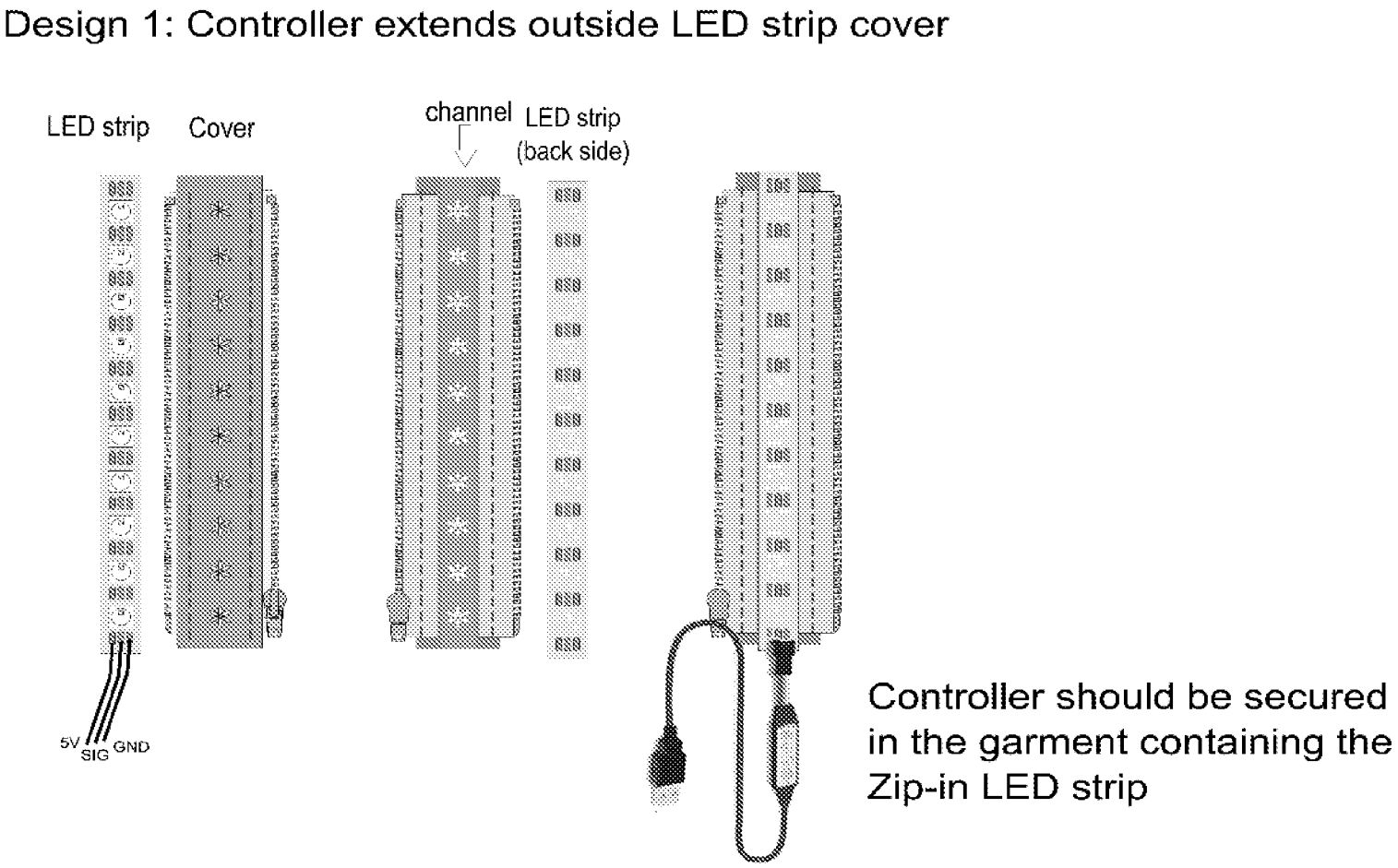
FIG. 16 illustrates one embodiment of the invention in which a controller extends outside of the cover strip, in accordance with one aspect of the present invention.
Figure 17:
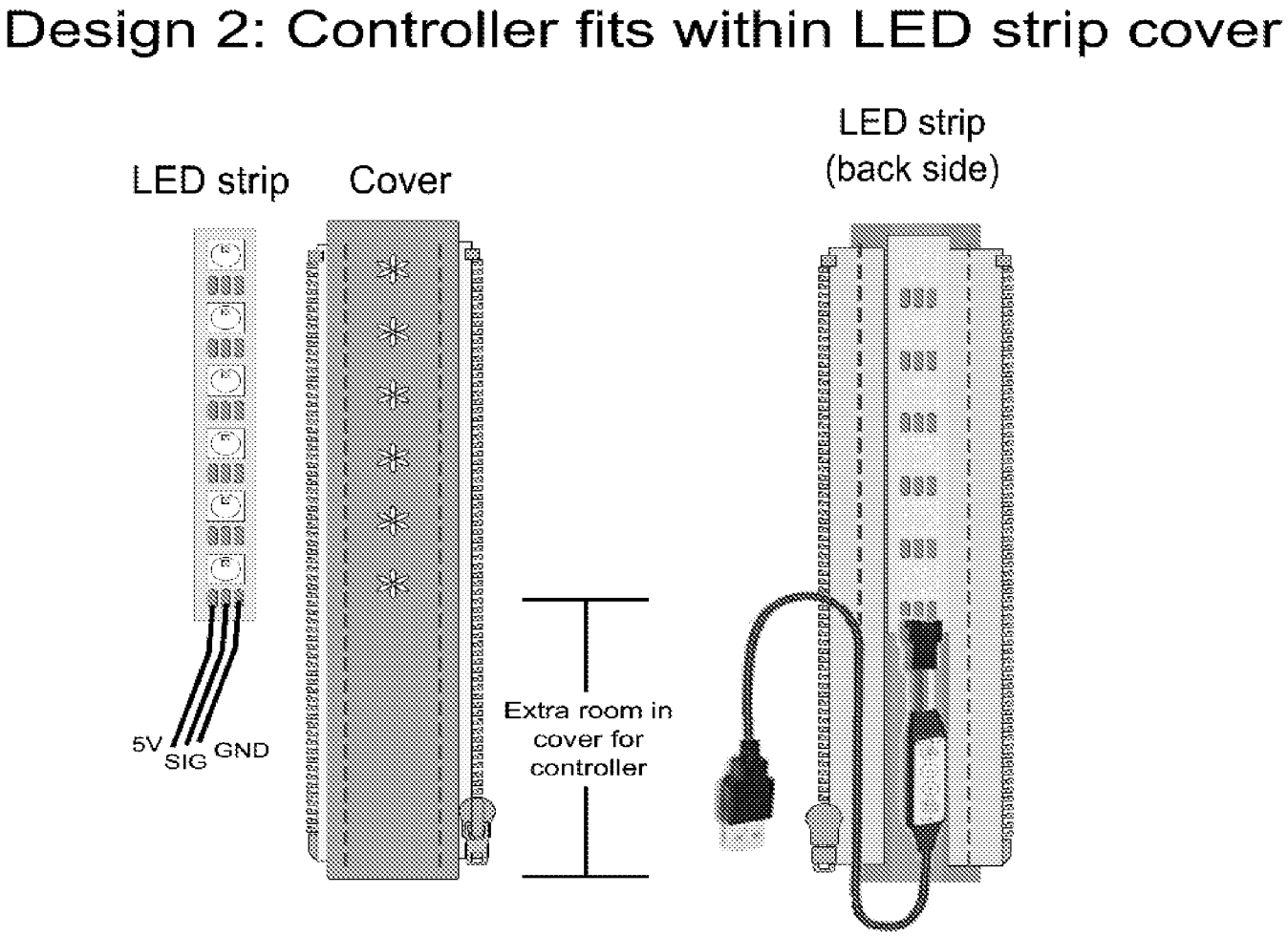
FIG. 17 illustrates another embodiment invention in which a controller is enclosed inside of the cover strip, in accordance with one aspect of the present invention.

The LED assembly strip may contain its own micro-controller and battery, or it may contain connectors that will attach to micro controllers and batteries embedded in the wearable item. These strips may be able to connect to each other to form a longer chain of LED displays. Referring to FIGS. 16 and 17, the controller can be either embedded in the light source strip or separate from the light source strip. In FIG. 16, a connector configured to attach to a controller is provided at the end of the light source strip. The same connector can also attach to another unit, for example another light source strip, which in turn connects to the controller. This controller is secured in another position in the garment. Referring to FIG. 17, the cover strip is longer than the light source strip and space is allocated to accommodate a controller and this controller is in one to one correspondence with the LED source strip.

The Power Source (Battery Pack)

In the scope of the present invention, different kinds of batteries and the different possible means of attachment to the PCB element are disclosed and described.

In general, the illumination sources (addressable RGB LEDs) used in the present invention require 3-5 Volts to function properly. Any battery pack meeting these conditions that can supply enough power to light all the LEDs and power the microcontroller can be used.

In order to provide the PCB assembly with an input voltage between 3 and 5 volts in a portable manner, a battery pack is used. Three examples of batteries which provide portable power in this voltage range are described below. A first example includes a pack of two (3V) or three (4.5V) alkaline AAA or AA batteries. A second example includes rechargeable LiPo batteries (3.7V). A third example includes a portable phone charger (5V). The first example is preferred when the modular system is included in wearables for children because it offers the lowest risk of fire.

In accordance with the teachings of the present invention, disclosed herein, in a fourth aspect, a method of using of the modular system is described.

In accordance with the teachings of the present invention, disclosed herein, a method of using the programmable light assembly is described. The interaction method offered by the present invention, allowing a user to adjust the illumination patterns/colors/brightness/timing protocol of the light source in the illumination elements. First a user inputs an instruction via a user interface. Subsequently data is transmitted from the user interface to a microcontroller. Then illumination instructions including color and timing protocols are computed and sent to the flexible light source strip.

Control/Instruction Flow

The illumination pattern of lights displayed on the LED strip is controlled by the controller connected to the strip. There are various methods of interacting with the controller that allow the user to select the state of various aspects of the display, including the illumination pattern, brightness, display speed, on/off state, current color, and number of LEDs illuminated in the strip.

Figure 18:
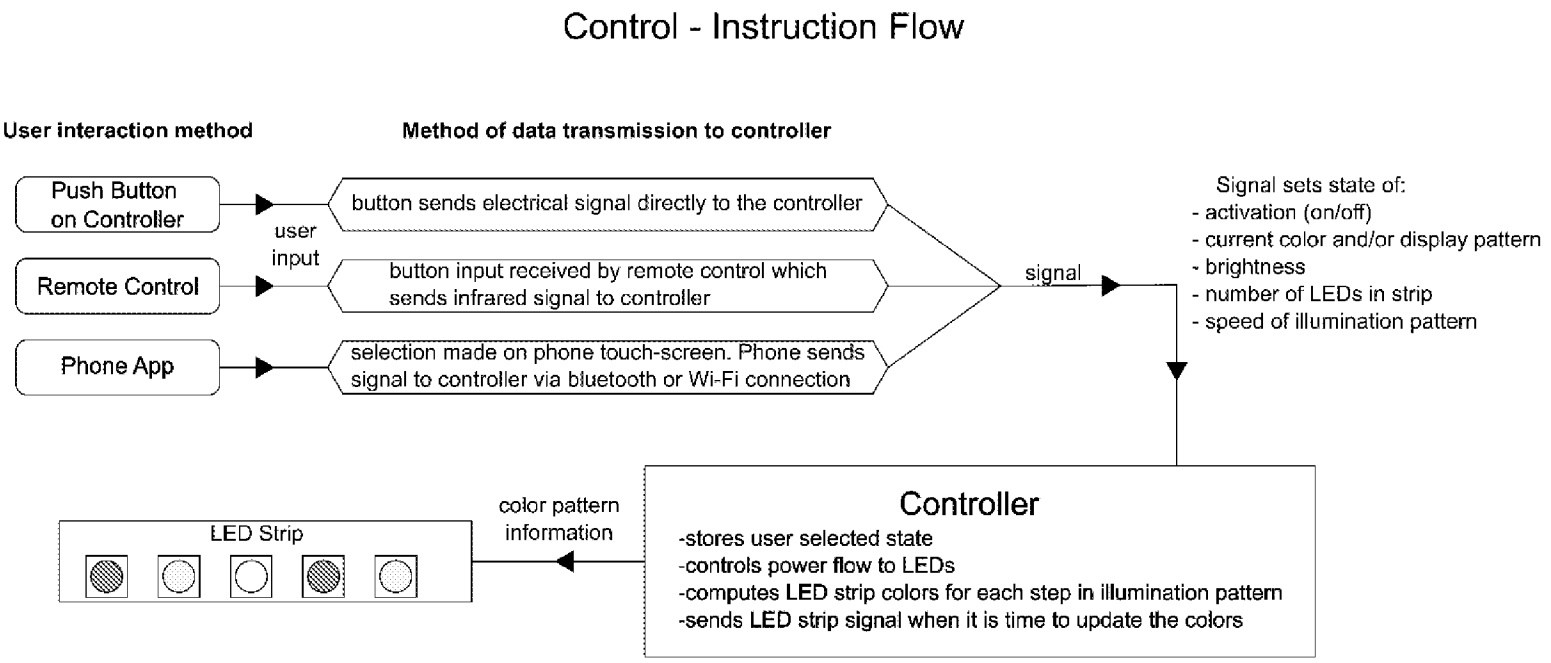
FIG. 18 illustrates how user instruction flows, in accordance with one aspect of the present invention.

The controller may have built-in buttons, an infrared remote-control containing button, or may be accessible via a phone app that connects to the controller via Bluetooth or WiFi. The flow of the instructions from the user to the LED strip is illustrated in the diagram in FIG. 18.

Illumination Pattern Creation/Modification and Selection

The controller stores a list of illumination patterns which can number from as few as one to as many as will fit in the electronic memory of the controller. The controller also stores the index into the list of the current pattern, or it may store a command to transition through all the stored patterns over a period of time.

The user may alter the display by sending a signal to the controller to select a different pattern from the stored list. The method of sending such a signal depends on whether the controller is intended to take input via push-button, remote control or phone app.

In one example, the present invention utilizes a pre-programmed LED strip controller. In another example, the present invention utilizes a dynamically-programmed LED strip controller. Pre-programmed LED strip controllers have a fixed, immutable list of patterns from which the user may select. The user may change the appearance of the display by selecting not only the illumination pattern, but the brightness and speed at which the illumination pattern is displayed. Dynamic-programmed LED strip controllers allow a user to change the list of patterns, and allow the user to add, delete or modify existing patterns in the list.

The appearance of the display pattern may be a result of a combination of both a pre-programmable LED strip controller and dynamic controller. The controller may be programmed by various methods, including a computer-based integrated development environment, a remote-control interface or a phone-based app.

Figure 19:
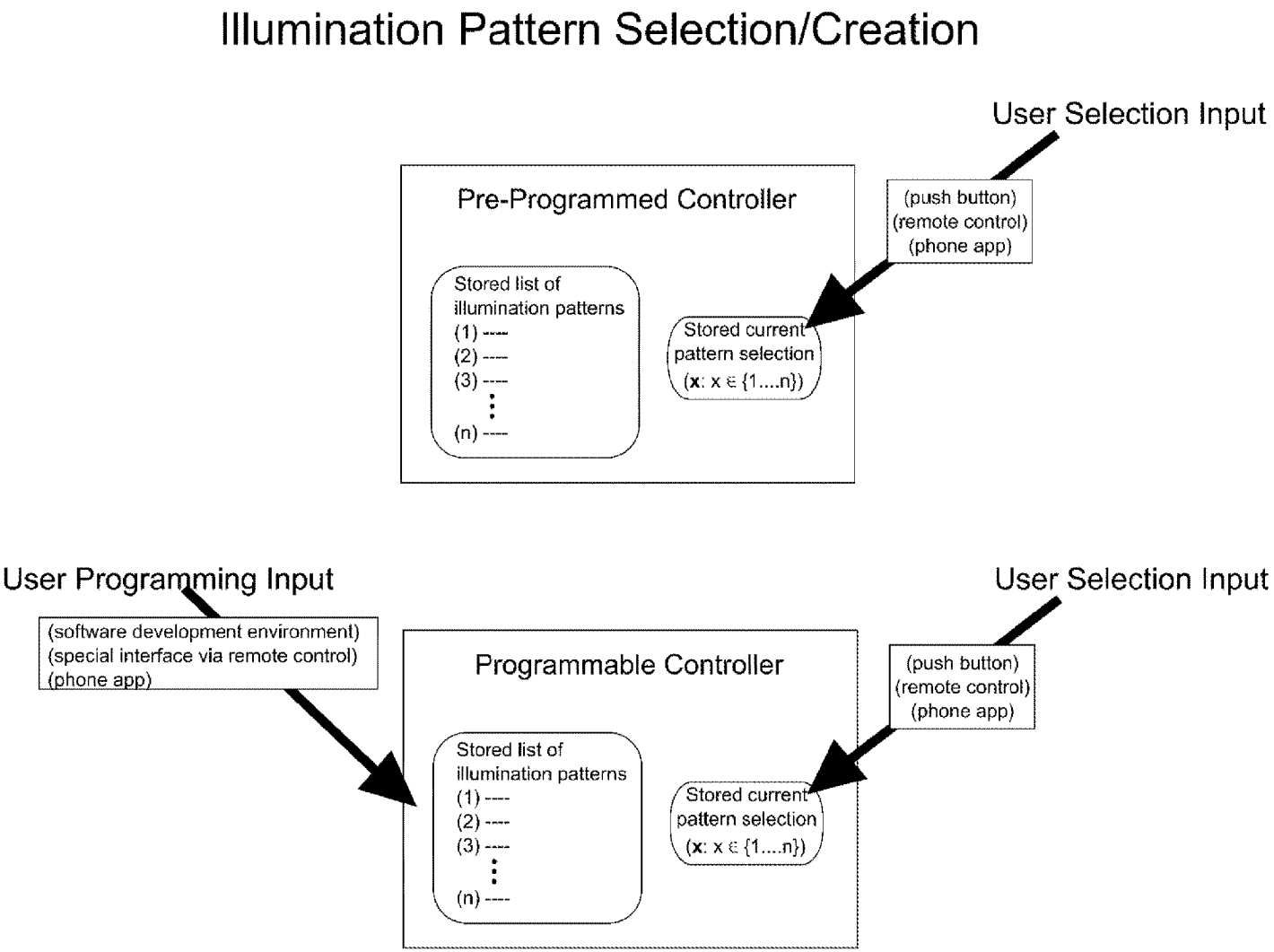
FIG. 19 an illumination parameter changes flows, in accordance with one aspect of the present invention.

An illustration of the methods of user illumination pattern selection for both the pre-programmed and programmable LED strip controller is shown in FIG. 19.

In accordance with the teachings of the present invention, disclosed herein, in a fifth aspect, a method of how the modular system is constructed is described. The method comprises providing a light strip, a cover strip and an engagement-and-separation strip; securing the engagement-and-separation strip to the cover strip along one side of the cover strip through a first attachment means to form a first combined cover-engagement assembly. The first combined cover-engagement assembly is flipped over and the light source strip is fitted into a channel formed by a flap of the engagement and separation strip and cover strip. The light strip is secured in place using a second securing means. The method further includes placing a protective bottom cover configured to protect the electronics of the light source strip on the back side of the light source strip. Optionally, the method further comprises placing a diffusing layer between the light source strip and cover strip to spread out the light from the light source.

Referring to FIGS. 2-8, the method of assembling a programmable light source strip is explained.

Figure 2:
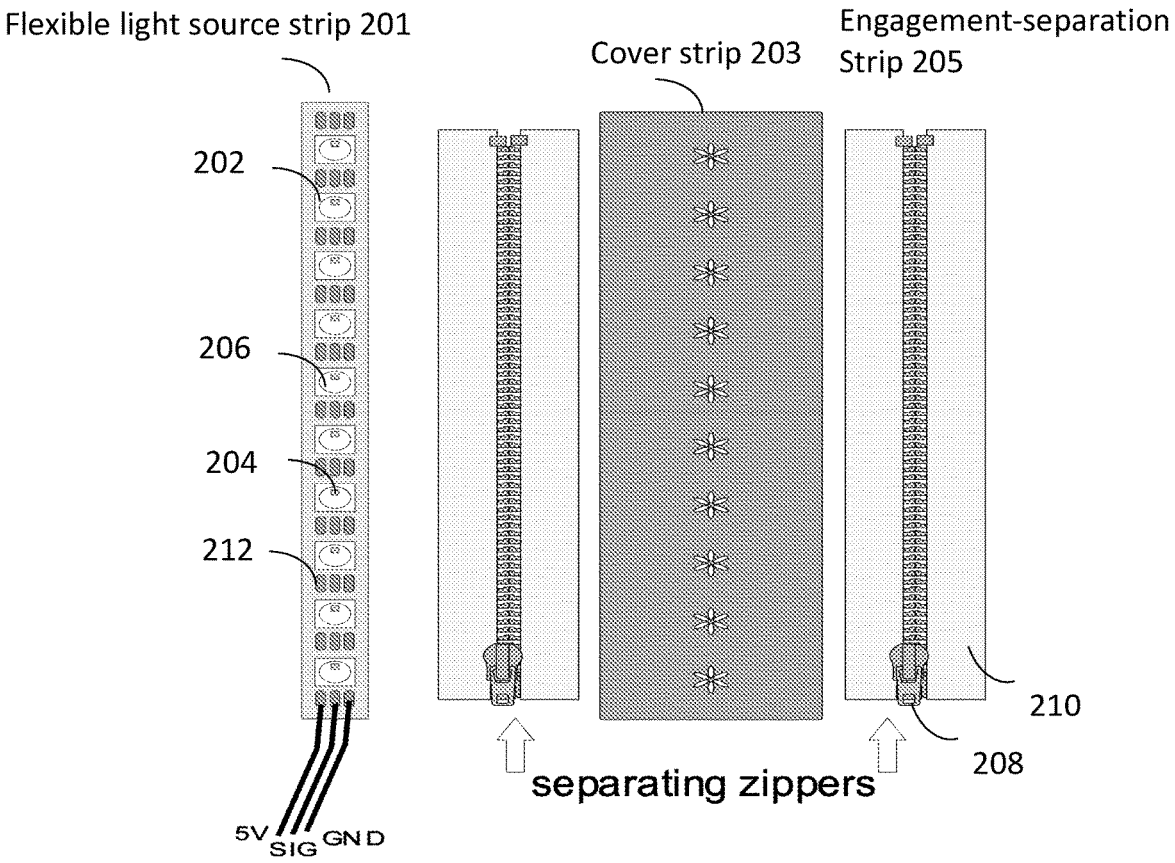
FIG. 2 shows components that are needed to form a programmable light assembly in one embodiment.
Figure 3:
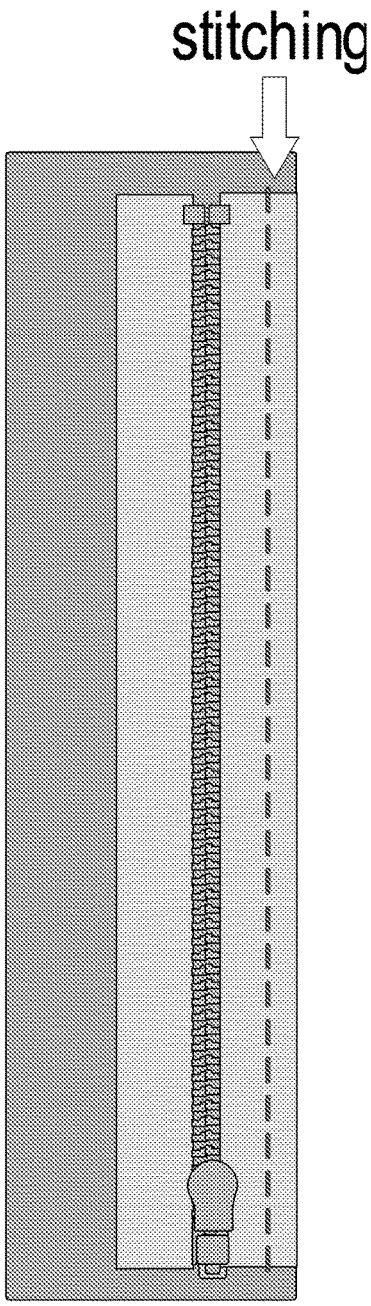
FIG. 3 shows that a flap member is first secured to the cover strip.
Figure 4:
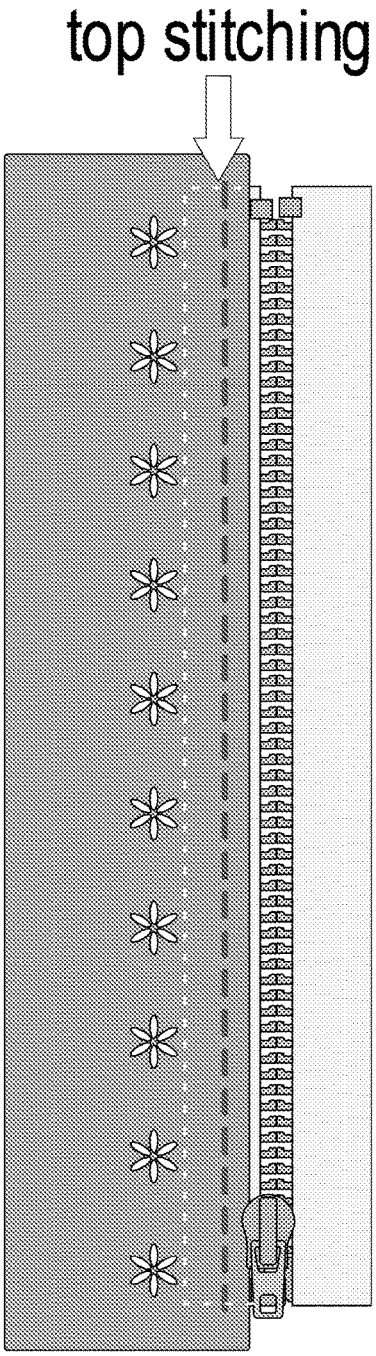
FIG. 4 shows a step in which top stitching is added to secure the cover strip and engagement-and-separation strip.

Step 1: placing a zipper assembly and a cover strip (vinyl/fabric strip) together with right sides (front faces) and sides aligned as shown in FIG. 2. The zipper and strip are stitched together parallel to the edge with a seam allowance (distance between the edge of the fabric and stitching) of about ⅜".

Step 2: Then the zipper assembly is opened and folded away from the cover strip so that both have their right sides facing the same direction. The seams of the of zipper assembly and cover strip are folded underneath the cover strip. Another line of top stitching is made just inside the folded edge of the vinyl strip to keep the fold in place.

Step 3: Repeat steps 1 and 2 with the second zipper on the other edge of the cover strip.

Step 4: Flipping the combined zipper/cover strip over, the edges of the zippers which have been folded towards the center form a channel. The LED strip fits inside the channel and can then be glued into place. The back of the LED strip can be covered with protective fabric or vinyl to protect the electronics. The LED strip is then connected to power and a microcontroller to illuminate the LEDs so they shine through the apertures in the vinyl as seen from the front. A thin layer of diffusing material may be placed between the LED strip and the vinyl fabric to diffuse the light from the LEDs.

Step 5: The unsewn sides of the zippers can then be attached to fabric to form a panel which is sewn into a garment.

Step 6: placing and attaching another layer of fabric behind the panel, so that when the LED strip is removed, the garment maintains its structure and looks attractive.

The elements are
light assembly 100
diffuse layer 102
a flexible light source strip 201
a flexible printed circuit board (PCB) 202
a plurality of RGB LEDs 204
concave support base 206
conductive elements 212
cover strip 203
joining elements 208
substrate 210
engagement-and-separation strip 205
a background pattern strip, 104
wearable article 800
protective layer 801
array of flexible light source strips 1201
micro-controller assembly 2201
battery assembly 2201
connector configured to attach to a micro-controller 2301

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to explain the principles of the invention and its practical applications, they thereby enable others skilled in the art to utilize the invention and various embodiments with various modifications as are suited to the particular use contemplated. It is intended that the following claims and their equivalents define the scope of the invention.

The invention claimed is:

1. A light assembly, comprising
a flexible light source strip, comprising
a flexible printed circuit board (PCB) as a substrate and
a plurality of RGB LEDs, placed on the flexible PCB at a pre-determined position, by adhesion or through a concave support base and the flexible PCB further comprises conductive elements;
a cover strip, comprising a plurality of orifices,
allowing the emission from the light source to exit from the cover strip, and the plurality of orifices is provided with light fixtures to enhance the illumination effects;
an engagement-and-separation strip, comprising a series of joining elements, secured on a substrate, distributed evenly along a length of the engagement-and-separation strip; and
a background pattern strip,
wherein the light assembly is configured to installed to a wearable article in a vertical, horizontal or an angled orientation, with respect to one seam line of the wearable article.

2. The light assembly of claim 1, further comprising a diffusion layer, disposed between the flexible light source strip and the cover strip.

3. The light assembly of claim 1, wherein joining members include zippers, Velcro, magnets, and buttons.

4. The light assembly of claim 1 is part of the wearable article selected from a garment or accessory item.

5. The light assembly of claim 1, wherein the wearable article comprises an array of flexible light source strips, connecting through a neighboring engagement-and-separation strip.

6. The light assembly of claim 1 further comprises a micro-controller assembly and a battery assembly, wherein the micro-controller is secured in the wearable article or the micro-controller is secured in the back of flexible light source strip.

7. The light assembly of claim 1, wherein the plurality of RGB LEDs are arranged in an array and configured display letters or in a pattern configured to generate a display to show Alphabetic Letters or Arabic numerals.

8. The light assembly of claim 1, wherein the plurality of orifices have a wide variety of the shapes, including a flower shape or a round shape;
are provided with a plurality of LED bead covers or shades, including rhinestones or glass cabochons, allowing the light from the RGB LED beads to diffuse through.

9. The light assembly of claim 2, wherein the diffusion layer is one or more strips of translucent fabric, shiny reflective (but translucent) vinyl, or any flexible translucent material, configured to enhance the light effects.

10. The light assembly of claim 1, further comprises a protective layer,
a fabric layer which is placed outside of the area of the flaps of the engagement-and-separation strip, configured to offer more structural integrity and protection, and to insulate a wearer from contact with electronics for the LEDs in flexible light source strip.

11. The light assembly of claim 1, further comprising a connector configured to attach to a first micro-controller provided at an end of a first light source strip and also attach to a second micro-controller of a flexible light source strip, secured in another position in the wearable article.

12. The light assembly of claim 1, wherein the cover strip is longer than the light source strip and space is allocated to accommodate a controller and the controller is in one to one correspondence with the flexible light source strip.

13. A method of making a light assembly, comprising
providing a light strip, a cover strip and an engagement-and-separation strip;
securing the engagement-and-separation strip to the cover strip along one side of the cover strip through a first attachment means to form a first combined cover-engagement assembly;
flipping the first combined cover-engagement assembly over;
placing and fitting the light source strip inside a channel formed by a flap of the engagement and separation strip and cover strip and securing the light strip in place using a second securing means.

14. The method of claim 13 further comprising
placing a protective bottom cover configured to protect the electronics of the light source strip on the back of the light source strip, Optionally, the method further comprises placing a diffusing layer between the light source strip and cover strip to diffuse the light from the light source.

* * * * *